US009933797B1

(12) United States Patent
Lebon

(10) Patent No.: US 9,933,797 B1
(45) Date of Patent: Apr. 3, 2018

(54) BANDGAP VOLTAGE GENERATOR AND METHOD

(71) Applicant: STMicroelectronics (Alps) SAS, Grenoble (FR)

(72) Inventor: Frederic Lebon, Grenoble (FR)

(73) Assignee: STMicroelectronics (Alps) SAS, Grenoble (FR)

( * ) Notice: Subject to any disclaimer, the term of this patent is extended or adjusted under 35 U.S.C. 154(b) by 0 days.

(21) Appl. No.: 15/495,504

(22) Filed: Apr. 24, 2017

(30) Foreign Application Priority Data

Nov. 9, 2016 (FR) ..... 16 60832

(51) Int. Cl.
*G05F 3/22* (2006.01)
*G05F 1/46* (2006.01)
*G05F 3/30* (2006.01)

(52) U.S. Cl.
CPC ..... *G05F 1/468* (2013.01)

(58) Field of Classification Search
CPC ..... G05F 3/00; G05F 3/10; G05F 3/16; G05F 3/20; G05F 3/205; G05F 3/22; G05F 3/222; G05F 3/225; G05F 3/227
See application file for complete search history.

(56) References Cited

U.S. PATENT DOCUMENTS 5,394,078 A * 2/1995 Brokaw ..... G01K 7/01 323/313
5,726,563 A * 3/1998 Bolton, Jr. ..... G05F 3/267 323/313
5,963,105 A 10/1999 Nguyen
7,453,252 B1 11/2008 Megaw
2002/0036489 A1 3/2002 Cocetta
2002/0149089 A1 10/2002 Vendrame et al.
2002/0158682 A1 10/2002 Conte et al.
2005/0151526 A1 7/2005 Cali et al.
2010/0163888 A1 7/2010 Saggio et al.
(Continued)

OTHER PUBLICATIONS

Colombo, Dalton, et al., "Curvature Correction Method Based on Subthreshold Currents for Bandgap Voltage References", Circuits and Systems (LASCAS), 2012 IEEE Third Latin American Symposium, Feb. 29, 2012, pp. 1-4.
(Continued)

*Primary Examiner* — Gary L Laxton
(74) *Attorney, Agent, or Firm* — Slater Matsil, LLP

(57) ABSTRACT

An integrated electronic device includes a core having a first terminal and a second terminal. The core includes a first branch with a first diode-connected bipolar transistor coupled in series to a first resistor between the first terminal and a reference terminal intended to be supplied with a reference voltage, and a second branch with a second diode-connected bipolar transistor coupled between the second terminal and the reference terminal. The second diode-connected bipolar transistor has a current density higher than the first diode-connected bipolar transistor. The core also includes a first resistive network coupled between a base of the first diode-connected bipolar transistor and the reference terminal. An equalizer is configured to equalize potentials of the first terminal and of the second terminal and a voltage generator is coupled to the first and second terminals of the core and configured to generate the bandgap voltage.

20 Claims, 3 Drawing Sheets

(56) References Cited

U.S. PATENT DOCUMENTS

| | | | | |
|---|---|---|---|---|
| 2011/0057718 | A1 | 3/2011 | Snoeij et al. | |
| 2012/0169413 | A1 | 7/2012 | Choi | |
| 2012/0256605 | A1 | 10/2012 | Lecce et al. | |
| 2012/0293143 | A1 | 11/2012 | Fort et al. | |
| 2012/0293149 | A1 | 11/2012 | Fort et al. | |
| 2013/0015835 | A1 | 1/2013 | Corradi et al. | |
| 2013/0095624 | A1 | 4/2013 | Saggio et al. | |
| 2013/0169259 | A1 | 7/2013 | Saxena et al. | |
| 2014/0070788 | A1 | 3/2014 | Pottbaecker et al. | |
| 2014/0176113 | A1* | 6/2014 | Fan | G05F 3/242 323/313 |
| 2014/0239936 | A1* | 8/2014 | Paglino | G05F 3/26 323/313 |
| 2016/0327972 | A1 | 11/2016 | Ippolito et al. | |

OTHER PUBLICATIONS

Meijer, G.C.M., "Features and Limitations of CMOS Voltage References," Proceedings of the 8th National Scientific and Applied Science Conference, Sozopol, Sep. 23-25, 2000, Technical University Sofia, Sofia, 2000, p. 17-23.

* cited by examiner

BANDGAP VOLTAGE GENERATOR AND METHOD

CROSS-REFERENCE TO RELATED APPLICATIONS

This application claims priority to French Patent Application No. 1660832, filed on Nov. 9, 2016, which application is hereby incorporated herein by reference.

TECHNICAL FIELD

Implementations and embodiments of the invention relate to a bandgap voltage generator and a method for the generation of voltage, especially to the generation of a bandgap voltage.

BACKGROUND

A bandgap voltage is a voltage that is substantially independent of temperature, and devices generating such voltages are widely used in integrated circuits.

Generally, a circuit generating a bandgap voltage delivers an output voltage of about 1.25 volts, similar to the bandgap of silicon at the temperature of o kelvin, which is equal to 1.22 eV.

Generally, the voltage difference between two PN junctions (for example, diodes or diode-connected bipolar transistors), the current densities of which are different, allows a current proportional to absolute temperature, generally known to those skilled in the art as a "PTAT current" (PTAT being the acronym of "proportional to absolute temperature"), to be generated through a resistor.

Moreover, the voltage across the terminals of a diode or a diode-connected transistor, through which a current, such as a PTAT current, is flowing, is a voltage including a term that is inversely proportional to absolute temperature, and a second-order term, i.e., one that varies nonlinearly with absolute temperature. Such a voltage is nevertheless designated a "CTAT voltage" by those skilled in the art (CTAT being the acronym of "complementary to absolute temperature").

A bandgap voltage may then be obtained from the PTAT and CTAT currents by suitably choosing the resistors through which these two currents flow, making it possible to cancel out the contribution of the temperature factor for a given temperature so as to make this so-called bandgap voltage theoretically independent of temperature about the given temperature.

However, in practice the CTAT voltage includes a non-linear component (i.e., its expression includes a term of the second order).

Thus, the bandgap voltage also includes a non-linear component. It is therefore not perfectly independent of temperature.

One way of improving the precision of the bandgap-voltage source would therefore be to decrease this non-linear component.

Ways to compensating for the non-linear component of the CTAT voltage already exist and, for example, implement the addition of components of various types and especially components having different temperature coefficients. However, it is currently difficult or expensive to procure components the temperature coefficients of which are different enough to produce these circuits.

SUMMARY

Implementations and embodiments of the invention relate to the generation of voltage, especially to the generation of what is called bandgap voltage, and more particularly to the attenuation of the non-linear component of this bandgap voltage. Thus, according to one embodiment, a device is provided for generating a bandgap voltage, in which device the non-linear component is attenuated or even compensated for in a simple manner.

According to one aspect, an integrated electronic device is provided for generating a bandgap voltage. The device includes a core comprising a first terminal and a second terminal. The core includes a first branch comprising a first PN junction coupled in series to a first resistor between the first terminal and a reference terminal intended to be supplied with a reference voltage, for example, ground, and a second branch including a second PN junction coupled between the second terminal and the reference terminal. The two PN junctions are configured so that their current densities are different. The device also includes an equalizer that is configured to equalize the potentials at the first terminal and at the second terminal, and a voltage generator that is coupled to the two terminals of the core and configured to generate the bandgap voltage.

The structures of the equalizer and of the voltage generator coupled to the two terminals of the core and configured to generate the bandgap voltage may be chosen from many known conventional structures.

According to one general feature of this aspect, which is compatible with an equalizer or voltage generator of any structure, the second PN junction has a current density higher than the current density of the first PN junction, the first PN junction and second PN junction respectively include at least one first diode-connected bipolar transistor and at least one second diode-connected bipolar transistor, and the core includes at least one first resistive network coupled between the base of the at least one first transistor and the reference terminal.

Bipolar transistors possess non-ideal properties, especially due to their base access resistance. Furthermore, because of this access resistance, the base-emitter voltage of bipolar transistors includes a non-linear component.

The inventor has observed that it is advantageous to use this non-ideal property in order to attenuate, or even compensate for, the non-linear component of the bandgap voltage, and therefore to attenuate the curvature thereof. Thus, the addition of at least one additional resistor between the base of the transistor having the highest current density and the reference terminal allows the base resistance of this transistor to be increased and therefore a non-linear component that will already attenuate the curvature of the bandgap voltage, independently of whether any additional resistor is coupled to the base of the other transistor, to be generated.

This being so, it is possible to obtain a greater attenuation of or even to compensate for this curvature by coupling a second resistive network between the base of the at least one second transistor and the reference terminal, the resistance of the first resistive network being higher than that of the second resistive network, though not necessarily in the same ratio as that of the current densities.

In practice, it is preferable for the first resistive network and the second resistive network to have resistances chosen so as to obtain a bandgap voltage with a peak-to-trough amplitude lower than a threshold.

In the prior art, the peak-to-trough amplitude of the bandgap voltage may be higher than 3 mV.

Also, the resistances of the two resistive networks may be chosen so as to obtain a bandgap voltage with a peak-to-trough amplitude lower than 3 mV.

This being so, this threshold may be set to 1 mV.

The inventor has shown that it is even possible, via a suitable choice of these resistances, to obtain a bandgap voltage with a peak-to-trough amplitude that does not exceed 0.7 MV.

The resistances of these resistive networks may be determined by measurement or by simulation in a phase in which the integrated electronic device for generating a bandgap voltage is tested.

In this test phase, to obtain the desired resistances, sets of resistors that can be selectively short-circuit, for example, using transistors that may be selectively turned on, will possibly be used by way of resistive networks.

Once the test has been carried out, single resistors having the obtained resistance may be used by way of first and second resistive networks.

This being so, it is also possible to leave in place, within the integrated electronic device for generating a bandgap voltage, the sets of resistors used for the test with certain thereof short-circuited by the corresponding turned-on transistors.

Thus, according to one embodiment, the first resistive network and the second resistive network respectively include a first group of identical resistors that are connected in series and a second group of identical resistors that are connected in series, at least one of the resistors being short-circuited.

According to one embodiment, the device furthermore includes a plurality of control transistors that are respectively coupled in parallel to the resistors of the two groups, one at least of the transistors being in an on state and the other transistors being in an off state.

According to another aspect, a method is provided for attenuating the peak-to-trough amplitude of a bandgap voltage delivered by a bandgap-voltage source including a core comprising at least one diode-connected first transistor and at least one diode-connected second transistor that are configured so that the second transistor has a current density higher than that of the first transistor, the method comprising producing at least one coupling between the base of the at least one first transistor and a reference terminal that is supplied with a reference voltage, ground for example, of a first resistive network.

According to one implementation the method furthermore comprises producing a coupling between the base of the at least one second transistor and the reference terminal of a second resistive network having a resistance lower than that of the first resistive network.

According to one implementation, the method comprises an adjustment of the resistances of the first resistive network and of the second resistive network so as to obtain a bandgap voltage with a peak-to-trough amplitude lower than a threshold, for example, 1 millivolt.

According to one implementation, the method comprises coupling a first group of resistors between the base of the at least one first transistor and the reference terminal and coupling a second group of resistors between the base of the at least one second transistor and the reference terminal, and the adjustment is made by short-circuiting at least one of the resistors of the first group or of the second group.

BRIEF DESCRIPTION OF THE DRAWINGS

Other advantages and features of the invention will become apparent on examining completely non-limiting implementations and embodiments of the invention and the appended drawings, in which.

DETAILED DESCRIPTION OF ILLUSTRATIVE EMBODIMENTS

Figure 1:
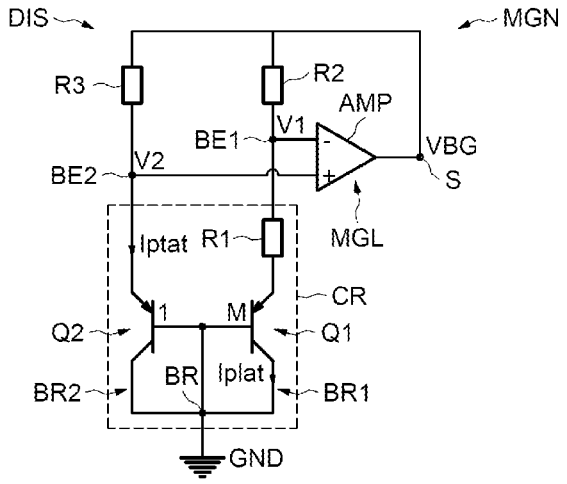
FIG.1 PRIOR ART
FIGS. 1 and 2 schematically show the conventional way in which a bandgap voltage is generated.

In FIG. 1, the reference DIS designates a conventional device for generating a bandgap voltage VBG.

The device DIS includes a core CR arranged so that, when the voltages V1 and V2 at its first terminal BE1 and at its second terminal BE2, respectively, are equalized by the equalizer MGL, an internal current Iptat proportional to absolute temperature flows therethrough.

Moreover, the device includes voltage generator MGN coupled to the two terminals BE1 and BE2 of the core and configured to generate at the terminal S the bandgap voltage VBG.

The core CR here includes a first PNP diode-connected bipolar transistor (referenced Q1) that is connected in series with a resistor R1 between the first terminal BE1 and a reference terminal BR that is intended to be supplied with a reference voltage that here is ground GND. The first transistor in series with the resistor R1 here forms a first branch BR1 of the core CR.

The core CR also includes a second PNP diode-connected bipolar transistor (referenced Q2) that is connected in series between the second terminal BE2 of the core and the reference terminal BR. The second transistor Q2, which is coupled between the second terminal BE2 and the reference terminal BR, here forms a second branch BR2 of the core CR.

In the described example, it is the second transistor Q2 that has the highest current density.

Thus, the size of the first transistor Q1 and the size of the second transistor Q2 are different and their areas in a ratio M, so that the current density flowing through the second transistor Q2 is M times higher than the current density flowing through the first transistor Q1.

The device also includes here an amplifier AMP, the inverting input of which is coupled to the first terminal BE1 of the core CR, and the non-inverting input of which is coupled to the second terminal BE2 of the core CR.

The amplifier AMP includes a negative-feedback stage ETR including a second resistor R2 that is connected between the output S of the amplifier AMP and the first terminal BE1, and a third resistor R3, of resistance equal to the resistance of the second resistor R2, that is connected between the output S of the amplifier AMP and the second terminal BE2.

The amplifier AMP, by virtue of its negative-feedback stage ETR, is thus arranged to equalize the voltages V1 and V2 at the terminals BE1 and BE2 of the core CR.

As is well known to those skilled in the art, when the voltages V1 and V2 are equal or substantially equal, the internal current Iptat flowing through the resistor R1 is then proportional to absolute temperature and equal to $$\frac{K*T}{R1*q}*\mathrm{Log}(M)$$

where K designates Boltzmann's constant, T absolute temperature, q the charge on an electron, and Log the Napierian logarithm function.

Furthermore, it is also known to those skilled in the art that the voltage VBE across the terminals of a diode-connected transistor through which a PTAT current is flowing is a CTAT voltage that is inversely proportional to absolute temperature.

Thus, the voltage V2 across the terminals of the transistor Q2, which voltage is equal to VBE2, is a CTAT voltage.

It is thus possible to obtain at the output S of the amplifier a bandgap voltage VBG that here is equal to the sum of the voltage V2 and of the voltage V1, i.e., $$VBE2 + R2 * \frac{K * T}{R1 * q} * \mathrm{Log}(M).$$

The equalizer MGL and the voltage generator MGN here especially incorporate the amplifier AMP.

This being so, this is merely one particular exemplary structure usable for these circuits MGL and MGN, and many other known exemplary structures may be used.

Figure 2:
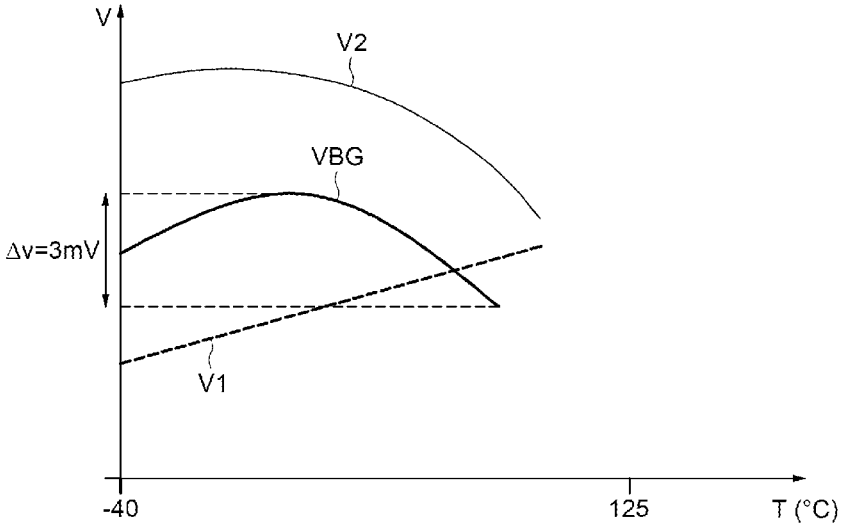
FIG.2 PRIOR ART

As illustrated in FIG. 2, the CTAT voltage V2 is not linear. Therefore, the voltage VBG, which is the sum of the PTAT voltage V1 and the CTAT voltage V2 is not linear but curved. It here possesses a nonzero peak-to-trough amplitude Δv, for example, here an amplitude Δv of 3 millivolts.

Moreover, the base resistance of a bipolar transistor is the cause of a non-linear component in its base-emitter voltage, and in particular here in the voltage V1 since the first transistor Q1 is diode-connected.

This effect, which is often considered in the literature to be a parasitic effect, will be amplified and adjusted in order to attenuate the non-linear component of the voltage VBG, and therefore to decrease its peak-to-trough amplitude, as will be seen below.

Figure 3:
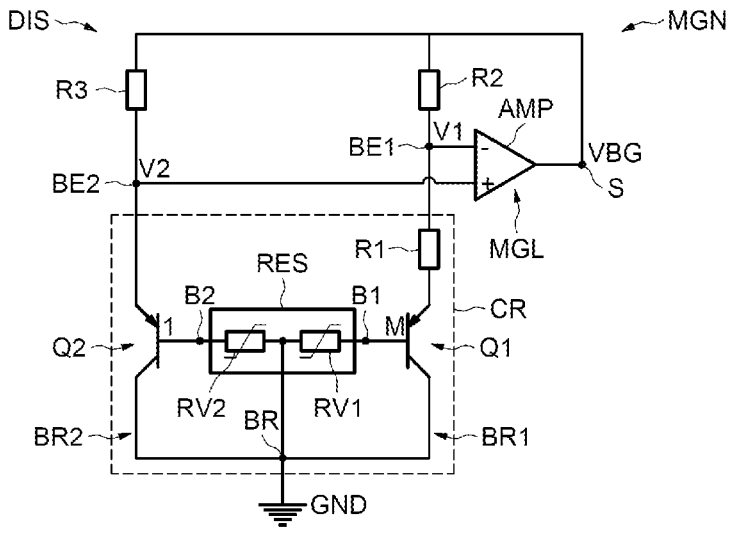
FIGS. 3 to 5 show implementations and embodiments of the invention.

Thus, as illustrated in FIG. 3, which relates to one embodiment of the invention, a resistance circuit RES has been coupled between the bases B1 and B2 of the two transistors Q1 and Q2 and the reference terminal BR has been connected to ground GND.

In this embodiment, the size of the first transistor Q1 and the size of the second transistor Q2 are different and their areas in a ratio M, so that the current density flowing through the second transistor Q2 is M times higher than the current density flowing through the first transistor Q1.

Here for example, the size of the first transistor Q1 is eight times larger than the size of the second transistor Q2.

Of course, it would also be possible to use one transistor Q2 and M transistors Q1 in parallel, the latter transistors all being of the same size as the second transistor Q2.

The resistance circuit RES includes a first resistive network RV1, which is coupled between the base B1 of the first transistor Q1 and ground GND, and a second resistive network RV2, which is coupled between the base B2 of the second transistor Q2 and ground GND.

The resistance of the first resistive network is higher than the resistance of the second resistive network by a factor N. Here the resistance of the second resistive network is six kilohms and the resistance of the first resistive network is twelve kilohms. Here, the factor N is therefore equal to two.

It will be noted here that the equalizer MGL and the generator MGN are given merely by way of example, and that the invention is compatible with any other equalizers and any other generators known to those skilled in the art.

Figure 4:
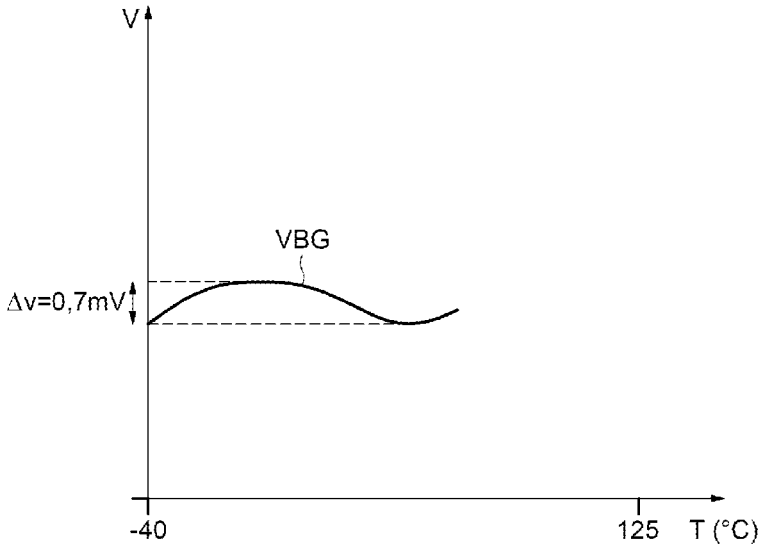

As illustrated in FIG. 4, the choice of these two resistances here advantageously allows the peak-to-trough amplitude of the bandgap voltage VBG to be attenuated, for example, in order to obtain a peak-to-trough amplitude value of 0.7 millivolts.

The resistances of the resistive networks RV1 and RV2 may be adapted, given the structure of the device for generating the bandgap voltage and the desired attenuation of the curvature given the envisaged application, by simulation and/or in a test phase.

Figure 5:
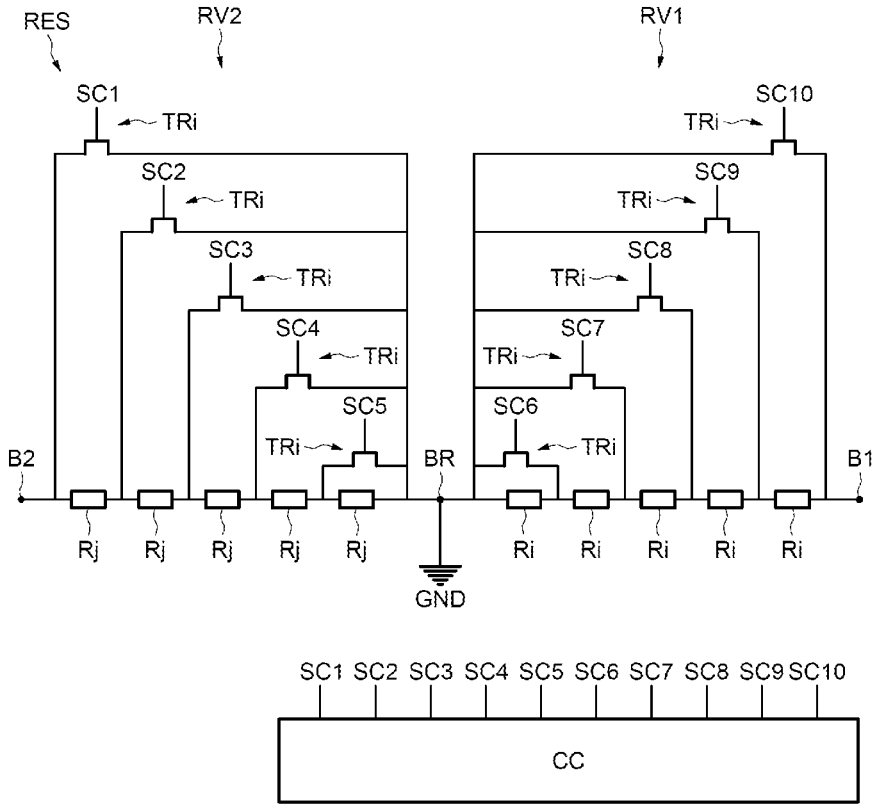

As illustrated in FIG. 5, it is possible to use, during the test phase, a resistance circuit RES in which the first resistive network RV1 and the second resistive network RV2 comprise groups of resistors.

The first group RV1 of resistors includes a plurality of identical resistors Ri that are connected in series, and the second group RV2 of resistors includes a plurality of identical resistors Rj that are connected in series. The resistance of a resistor R1 is higher than the resistance of a resistor Rj by the factor N, here two. For example, each resistor R1 has a resistance of 12 kilohms and each resistor Rj has a resistance of 6 kilohms.

Each of the resistors Ri and Rj is coupled in parallel to a transistor TRi that is configured to short-circuit the resistor when it is turned on.

The control electrode of each transistor TRi is coupled to a separate output of a control circuit CC common to all the transistors and configured to turn on or turn off one or more transistors simultaneously by sending control signals SC1, SC2, . . . SC10 to the control electrode.

Thus, the first resistive network and the second resistive network behave as varistors that may be adjusted in steps here of 12 kilohms and 6 kilohms, respectively.

The control circuit CC may, for example, but nonlimitingly be a five-bit decoder the outputs of which are each coupled to one transistor. Although groups RV1 and RV2 each comprising five resistors have been shown here, it will be noted that this representation is schematic and that in practice the resistance circuit RES may include a higher number of resistors.

By way of indication, in the test phase, for a given device, the voltage VBG is measured a plurality of times as a function of temperature for resistive networks RV1 and/or RV2 having different resistances obtained as indicated above by selectively short-circuiting certain of the resistors Ri and/or Rj, and the measurement for which the peak-to-trough amplitude is lowest is determined. To this measurement correspond two resistor resistances, which are therefore the resistances RV1 and RV2 to be used for the type of device tested.

The configuration of the resistive networks RV1 and RV2 that yielded these resistor resistances may then, for example, be set and used in the phase of normal operation of the device for generating bandgap voltage.

What is claimed is:

1. An integrated electronic device for generating a bandgap voltage, the device comprising:

a core comprising a first terminal and a second terminal, the core including a first branch comprising a first diode-connected bipolar transistor coupled in series to a first resistor between the first terminal and a reference terminal intended to be supplied with a reference voltage, and a second branch including a second diode-connected bipolar transistor coupled between the second terminal and the reference terminal, the second diode-connected bipolar transistor having a current density higher than the first diode-connected bipolar transistor, wherein the core further includes a first resistive network coupled between a base of the first diode-connected bipolar transistor and the reference terminal, and a second resistive network coupled between a base of the second diode-connected bipolar transistor and the reference terminal, wherein the first resistive network includes a first group of identical resistors that are connected in series and the second resistive network includes a second group of identical resistors that are connected in series, wherein at least one of the first group of identical resistors or of the second group of identical resistors is short-circuited;

an equalizer that is configured to equalize potentials of the first terminal and of the second terminal; and a voltage generator that is coupled to the first and second terminals of the core and configured to generate the bandgap voltage.

2. The device according to claim 1, wherein the first resistive network has a resistance higher than a resistance of the second resistive network.

3. The device according to claim 2, wherein the first resistive network and the second resistive network have resistances chosen so as to obtain a bandgap voltage with a peak-to-trough amplitude lower than a threshold.

4. The device according to claim 3, wherein the threshold is equal to one millivolt.

5. The device according to claim 1, further comprising a first plurality of control transistors and a second plurality of control transistors, each control transistor of the first plurality of control transistors being coupled in parallel with a respective one of the identical resistors of the first group of identical resistors and each control transistor of the second plurality of control transistors being coupled in parallel with a respective one of the identical resistors of the second group of identical resistors.

6. A circuit comprising:

a first terminal;

a second terminal;

a ground terminal;

a voltage terminal;

a first diode-connected bipolar transistor coupled in series with a first resistor between the first terminal and the ground terminal;

a second diode-connected bipolar transistor coupled between the second terminal and ground terminal, the second diode-connected bipolar transistor having a current density higher than the first diode-connected bipolar transistor;

a first resistive network coupled between a base of the first diode-connected bipolar transistor and the ground terminal;

a second resistive network coupled between a base of the second diode-connected bipolar transistor and the ground terminal, wherein the first resistive network includes a first group of resistors that are connected in series and the second resistive network includes a second group of resistors that are connected in series;

a first plurality of control transistors and a second plurality of control transistors, each control transistor of the first plurality of control transistors being coupled in parallel with a respective one of the resistors of the first group of resistors and each control transistor of the second plurality of control transistors being coupled in parallel with a respective one of the resistors of the second group of resistors; and an amplifier having a first input coupled to the first terminal and a second input coupled to the second terminal, an output of the amplifier being coupled to the first terminal through a second resistor and to the second terminal through a third resistor.

7. The circuit according to claim 6, wherein the first resistive network has a resistance higher than a resistance of the second resistive network.

8. The circuit according to claim 6, wherein the first resistive network and the second resistive network have resistances chosen so as to obtain a bandgap voltage with a peak-to-trough amplitude lower than a threshold.

9. The circuit according to claim 8, wherein the threshold is equal to one millivolt.

10. The circuit according to claim 6, wherein the first group of resistors is a first group of identical resistors having a first resistance and the second group of resistors is a second group of identical resistors having a second resistance.

11. The circuit according to claim 10, wherein the first resistance is higher than the second resistance.

12. A method for generating a bandgap voltage using a bandgap-voltage source that includes a core comprising a first diode-connected transistor and a second diode-connected transistor that are configured so that the second diode-connected transistor has a current density higher than a current density of the first diode-connected transistor, a base of the first diode-connected transistor being coupled to a reference voltage terminal through a first resistive network, a base of the second diode-connected transistor being coupled to the reference voltage terminal through a second resistive network, wherein the first resistive network comprises a first group of resistors coupled between the base of the first diode-connected transistor and the reference voltage terminal and the second resistive network comprises a second group of resistors coupled between the base of the second diode-connected transistor and the reference voltage terminal, the method comprising:

applying a voltage to a bandgap voltage terminal, the bandgap voltage terminal being coupled to the first diode-connected transistor through a first resistor that is connected to an emitter of the first diode-connected transistor, the bandgap voltage also coupled to the second diode-connected transistor through a second resistor that is connected to an emitter of the second diode-connected transistor;

generating the bandgap voltage based upon a voltage at the emitter of the first diode-connected transistor and a voltage at the emitter of the second diode-connected transistor; and adjusting resistances of the first resistive network and of the second resistive network so as to obtain a bandgap voltage with a peak-to-trough amplitude lower than a threshold, wherein the adjusting is performed by short-circuiting at least one of the resistors of the first group of resistors or of the second group of resistors.

13. The method according to claim 12, wherein generating the bandgap voltage comprises equalizing the voltage at the emitter of the first diode-connected transistor and the voltage at the emitter of the second diode-connected transistor.

14. The method according to claim 12, wherein the threshold is equal to one millivolt.

15. The method according to claim 12, wherein the first resistive network has a resistance higher than a resistance of the second resistive network.

16. The method according to claim 12, wherein the first group of resistors is a first group of identical resistors and the second group of resistors is a second group of identical resistors.

17. A bandgap circuit comprising:

a first bipolar transistor having a current path coupled between a first node and a reference node;

a second bipolar transistor having a current path coupled between the first node and the reference node;

an output node coupled to the first node;

a first resistive network coupled between a base of the first bipolar transistor and the reference node, the first resistive network comprising a first plurality of resistors coupled in series, each of the first plurality of resistors having a respective control transistor coupled in parallel; and a second resistive network coupled between a base of the second bipolar transistor and the reference node, the second resistive network comprising a second plurality of resistors coupled in series, each of the second plurality of resistors having a respective control transistor coupled in parallel, wherein at least one resistor of the first or second pluralities of resistors is short-circuited by its respective control transistor.

18. The bandgap circuit according to claim 17, further comprising a control circuit coupled to a control terminal of each of the control transistors.

19. The bandgap circuit according to claim 17, wherein the bandgap circuit is configured to produce a bandgap voltage in the output node with a peak-to-trough amplitude lower than a 0.7 mV.

20. The bandgap circuit according to claim 17, wherein each of the first plurality of resistors has first resistance, and each of the second plurality of resistors has a second resistance, the first resistance being higher than the second resistance.

* * * * *